US010290973B1

(12) United States Patent
Gisoldi et al.

(10) Patent No.: US 10,290,973 B1
(45) Date of Patent: May 14, 2019

(54) LEVER RELEASE FOR LEVER MATED CONNECTOR ASSEMBLY

(71) Applicant: TYCO ELECTRONICS BRASIL LTDA., Braganca Paulista (BR)

(72) Inventors: Mauricio Gisoldi, Braganca Paulista (BR); Gustavo Bonucci, Braganca Paulista (BR); Natanael Marcondes Santos, Braganca Paulista (BR)

(73) Assignee: TE CONNECTIVITY BRASIL INDUSTRIA DE ELECTRONICOS LTDA., Sao Paulo (BR)

( * ) Notice: Subject to any disclaimer, the term of this patent is extended or adjusted under 35 U.S.C. 154(b) by 0 days.

(21) Appl. No.: 15/952,400

(22) Filed: Apr. 13, 2018

(51) Int. Cl.
*H01R 13/629* (2006.01)

(52) U.S. Cl.
CPC ... *H01R 13/62955* (2013.01); *H01R 13/6295* (2013.01); *H01R 13/62944* (2013.01)

(58) Field of Classification Search
CPC ..... H01R 13/62944; H01R 13/62955
See application file for complete search history.

(56) References Cited

U.S. PATENT DOCUMENTS 6,558,176 B1 5/2003 Martin et al.
7,384,285 B2 6/2008 Patterson et al.
7,726,988 B2 * 6/2010 Martin ..... H01R 13/62944 439/157
7,749,004 B2 * 7/2010 Shuey ..... H01R 13/62944 439/157
8,535,073 B2 * 9/2013 Oiri et al. ..... H01R 13/62944 439/157
9,088,100 B2 * 7/2015 Volantin ..... H01R 13/62944 439/157
9,281,614 B1 3/2016 Bonucci et al.
9,755,358 B2 9/2017 Droesbeke et al.

OTHER PUBLICATIONS

Tyco Electronics Instruction Sheet 408-8827, 3 pgs, Feb. 23, 2011.

* cited by examiner

*Primary Examiner* — Tho D Ta

(57) ABSTRACT

An electrical connector assembly having a first housing, a second housing and a lever member. The first housing includes lever retention arms with holding projections. The second housing is matable with the first housing and has latch release projections and mating posts. The lever member is rotatably attached to the first housing to rotate from a first position to a second position. The lever member includes securing members and post engaging members. The securing members are configured to cooperate with the holding projections of the lever retention arms when the first housing is in the initial position to retain the lever member in the first position. The latch release projections are configured to release the holding projections of the lever retention arms from the securing members as the first housing is moved toward the final position, allowing the lever member to rotate to its second position.

18 Claims, 6 Drawing Sheets

LEVER RELEASE FOR LEVER MATED CONNECTOR ASSEMBLY

FIELD OF THE INVENTION

The present invention relates generally to lever mated connector assemblies for engaging resisting components. More particularly, the present invention relates to a mate assist assembly for connecting electrical contacts contained in separate housings.

BACKGROUND OF THE INVENTION

In certain applications, electronic components require the mating of several electrical contacts, such as in automotive electrical components. The electronic component includes a connector housing that holds several electrical contacts, while a mating connector housing holds an equal number of electrical contacts. One connector housing includes male electrical contacts, while the other connector housing includes female electrical contacts. As the number of electrical contacts to be mated increases, it becomes difficult to fully join the mating connector housings because of friction between the mating electrical contacts. The connector housings are formed with a mate assist assembly that includes a lever-and-gear system to pull together the connector housings in order to overcome the frictional resistance created by the mating electrical contacts.

U.S. Pat. No. 6,558,176 discloses an electrical connector which has first and second housings configured to be matable with one another to join electrical contacts. The first and second housings are movable between unmated and mated positions, at which the electrical contacts partially and fully mate, respectively. The electrical connector includes a lever member that engages the first and second housings, moving the first and second housings between the unmated and mated positions. The lever member includes a cam arm having first, second and third gear surfaces. The second housing includes first and second mating posts that are configured to engage the first, second and third gear surfaces at first, second and third distances, respectively, from the rotational axis as the lever member rotates from a first position to a second position to move the first and second housings between the unmated and mated positions. The first, second and third distances are all different.

While the lever member of U.S. Pat. No. 6,558,176 works properly in many situations, the lever member may be improperly rotated from its first position prior to the first and second housings being moved toward their mated positions. This can result in a failed or unstable electrical connection between the contacts of the housings, as the lever member does not properly cooperate with the mating posts to move the first and second housings to the mated position. In addition, if the lever member is improperly moved from its first position, the lever member may improperly engage the mating posts, thereby preventing the first and second housings from being moved to their mated position.

A need remains for a simple and effective latching/locking lever or member and latching/locking system which: can be reliably used over many cycles; ensures that the lever actuated connector is initially properly positioned in a mating connector prior to the lever being moved from an initial position or unmated position to a locked or mated position; ensures that the lever actuated connector remains continuously secured to the mating connector; and/or ensures that the lever actuated connector is not unintentionally moved out of the locked position.

SUMMARY OF THE INVENTION

An embodiment is directed to an electrical connector assembly having a first housing and a second housing. The first housing has a plurality of first contacts provided therein. The first housing includes lever retention arms with holding projections. The second housing is matable with the first housing and has a plurality of second contacts provided therein. The second housing has latch release projections and mating posts. The first housing and the second housing are movable between an initial position to a final position in which the first contacts are fully mated with the second contacts. A lever member is rotatably attached to the first housing to rotate from a first position to a second position. The lever member includes securing members and post engaging members. The securing members are configured to cooperate with the holding projections of the lever retention arms when the first housing is in the initial position to retain the lever member in the first position. The latch release projections are configured to release the holding projections of the lever retention arms from the securing members as the first housing is moved toward the final position, allowing the lever member to rotate to its second position. As the lever member is rotated from the first position to the second position, the post engaging members of the lever member engage the mating posts of the second housing to move the first housing to the final position.

An embodiment is directed to an electrical connector assembly having a first housing, a second housing and a lever member. The first housing has a plurality of first contacts provided therein. The first housing has lever retention arms on first housing end walls. The second housing is matable with the first housing and has a plurality of second contacts provided therein. The second housing has latch release projections on second housing end walls. The first housing and the second housing are movable between an initial position to a final position in which the first contacts are fully mated with the second contacts. The lever member is rotatably attached to the first housing to rotate from a first position to a second position, the lever member having securing members. The lever retention arms have holding projections with lever engaging shoulders which are configured to engage surfaces of the securing members to retain the lever member in a first position. The latch release projections have angled surfaces which are configured to engage the holding projections of the lever retention arms as the first housing is moved toward the final position to move the lever engaging shoulders away from the surfaces of the securing members to allow the lever member to rotate to its second position.

An embodiment is directed to an electrical connector assembly. A first housing of the electrical connector assembly has a plurality of first contacts provided therein. The first connector includes lever receiving openings on opposed end walls of the first connector for receiving portions of a lever member. The lever receiving openings have circular configurations to allow the lever member to rotate about a rotational axis, lever retention arms are proximate to, but offset from, the lever receiving openings. A lever member is rotatably attached to the first housing to rotate from a first position to a second position. The lever member has securing members and post engaging members. A second housing of the electrical connector assembly is matable with the first housing and has a plurality of second contacts provided therein, The second housing has latch release projections and mating posts. The latch release projections extend from end walls of the second connector in a direction away from opposed end walls of the second connector. The mating posts positioned are proximate to and extend outward from the end walls of the second connector. The first housing and the second housing are movable between an initial position to a final position in which the first contacts are fully mated with the second contacts. The securing members are configured to cooperate with the lever retention arms when the first housing is in the initial position to retain the lever member in the first position. The latch release projections are configured to release the lever retention arms from the securing members as the first housing is moved toward the final position, allowing the lever member to rotate to its second position. As the lever member is rotated from the first position to the second position, the post engaging members of the lever member engage the mating posts of the second housing to move the first housing to the final position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
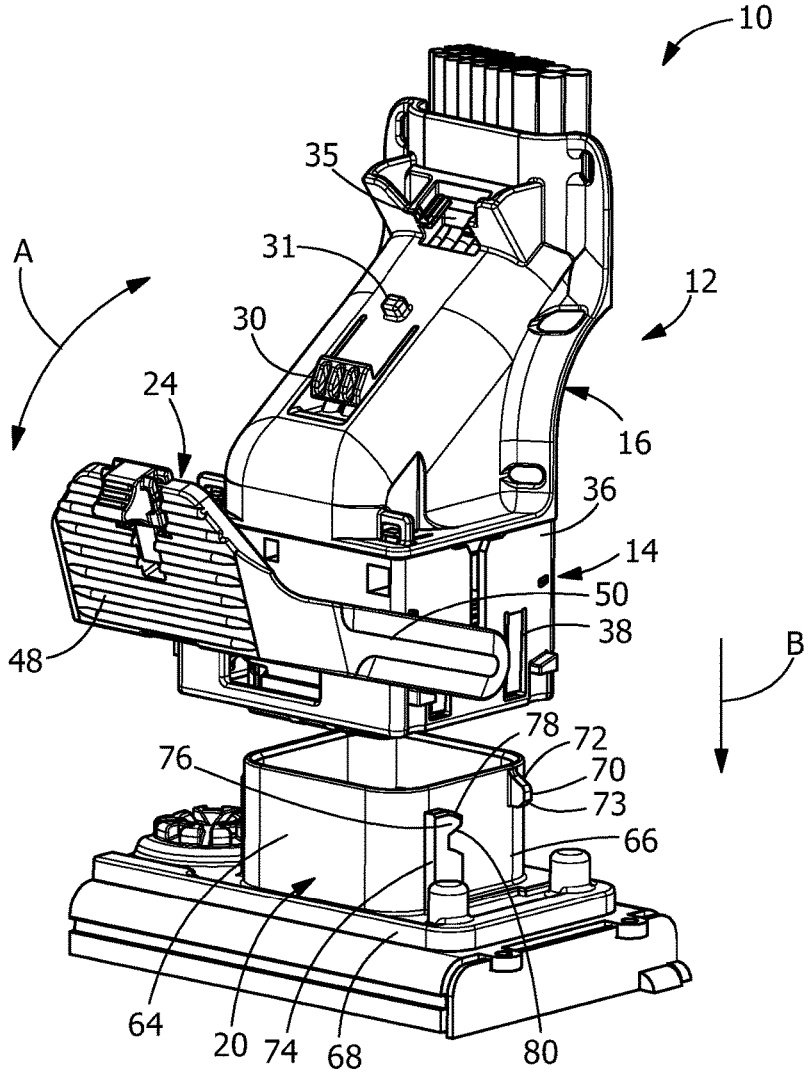
FIG. 1 is a perspective view of an illustrative a harness connector with a lever member prior to engaging a mating connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 10:
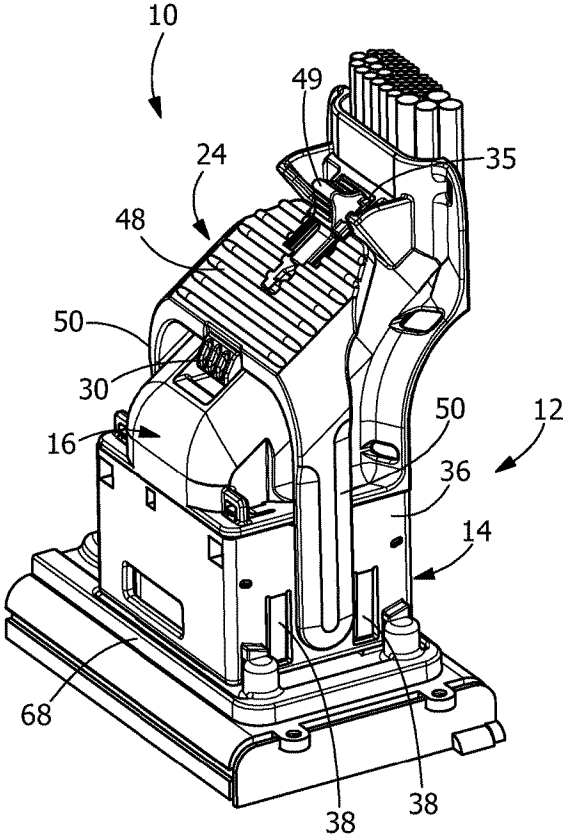
FIG. 10 is a perspective view of the harness connector and the mating connector of FIG. 1, illustrating the harness connector and the mating connector in the fully mated position, with the lever member of the harness connector rotated to its final and secured position.

Referring to FIG. 1, an electrical connector mate assist assembly 10 includes a first or harness connector 12 having a bottom portion 14 and a top portion 16. The bottom portion 14 is configured to position and retain electrical contacts 18 while the top portion 16 covers the electrical contacts. A second or mating connector 20 holds electrical contacts 22 which are configured to mate with the electrical contacts in the harness connector 12. In the position shown in FIG. 1, the harness connector 12 is positioned proximate the mating connector 20. A lever member 24 is retained on the harness connector 12 and engages the mating connector 20, as will be more fully described. The lever member 24 is rotatable in the direction of arrow A from the initial staging position (FIG. 1) to a final position (FIG. 10). As the lever member 24 is rotated, it forces the harness connector 12 downward in the direction of arrow B over the mating connector 20 and fully mates the electrical contacts 18 of the harness connector 12 and the electrical contacts 22 of the mating connector 20.

Figure 2:
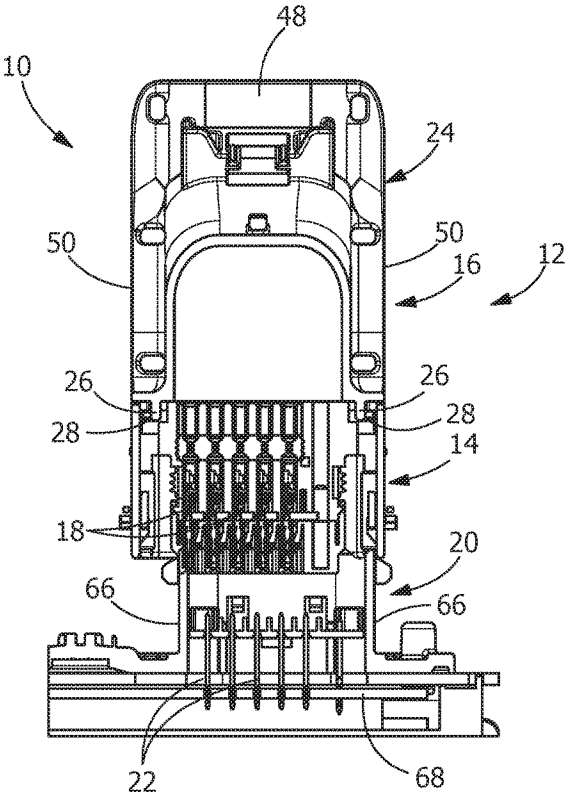
FIG. 2 is a cross-sectional view of the harness connector and the mating connector of FIG. 1, taken along line 2-2 of FIG. 1.
Figure 4:
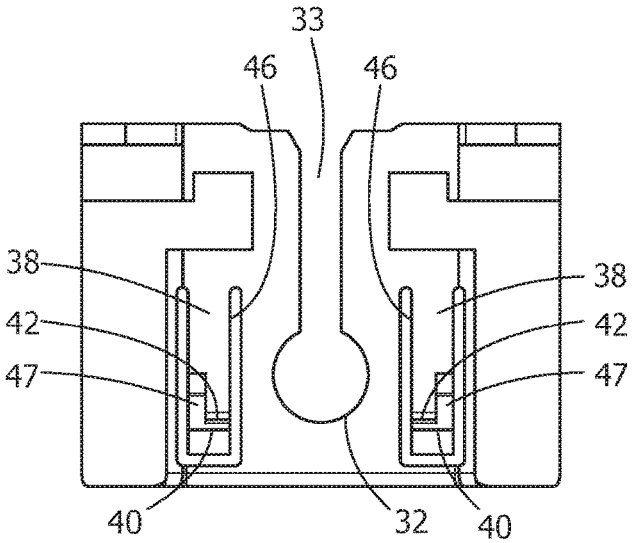
FIG. 4 is a side view of an end wall of the harness connector with the lever member removed.

The top portion 16 and the bottom portion 14 of the harness connector 12 are fastened together by retention latches 26 (FIG. 2) extending from the top portion 16 and engaging latch catches 28 of the bottom portion 14. However, other methods of mounting the top portions 14 to the bottom portion 16 may be used. The top portion 16 has a lever retaining projection 30 and a lever release locking projection 31 (as best shown in FIGS. 1 and 4) which are configured to retain the lever member 24 in the final position. A connector position assurance member receiving recess 35 is positioned on the top portion 16. The lever release locking projection 31 is positioned between the connector position assurance member receiving recess 35 and the lever retaining projection 30.

Figure 3:
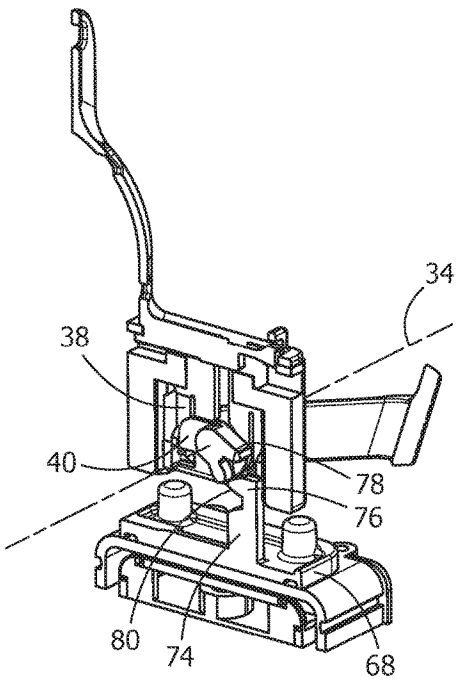
FIG. 3 is a cross-sectional view of the harness connector and the mating connector of FIG. 1, taken along line 3-3 of FIG. 1.

The bottom portion 14 of the harness connector 12 includes a lever receiving opening 32 on opposed end walls 36 for receiving a portion of the lever member 24 therein. At least a portion of each of the lever receiving opening 32 has a circular configuration to allow the lever member 24 to rotate about a rotational axis 34 (FIG. 3). The lever receiving opening 32 is provided at the end of slot 33.

At least one lever retention arm 38 is provided on each end wall 36. The lever retention arms 38 are proximate to, but offset from, the lever receiving openings 32. In the illustrative embodiment shown, the bottom portion 14 has two lever retention arms 38 on each end wall 36, with one lever retention arm 38 provided on either side of the lever receiving opening 32. This allows for the lever member 24 to be inserted into the lever receiving opening 32 in different orientations depending upon the orientation desired.

As best shown in FIGS. 4 and 10, the lever retention arms 38 have holding projections 40 provided at ends thereof. The holding projections 40 have lever engaging shoulders 42 which are configured to engage the lever, as will be more fully described. Angled or sloped surfaces 44 extend from free ends of the lever retention arms 38. Slots or openings 46 extend about the lever retention arms 38 to allow the lever retention arms 38 to move resiliently independent of the end walls 36. Engagement surfaces 47 extend from proximate the angled or sloped surfaces 44 to beyond the lever engaging shoulders 42. The engagement surfaces 47 are essentially parallel to and offset from the main portion of the lever retention arms 38.

Figure 5:
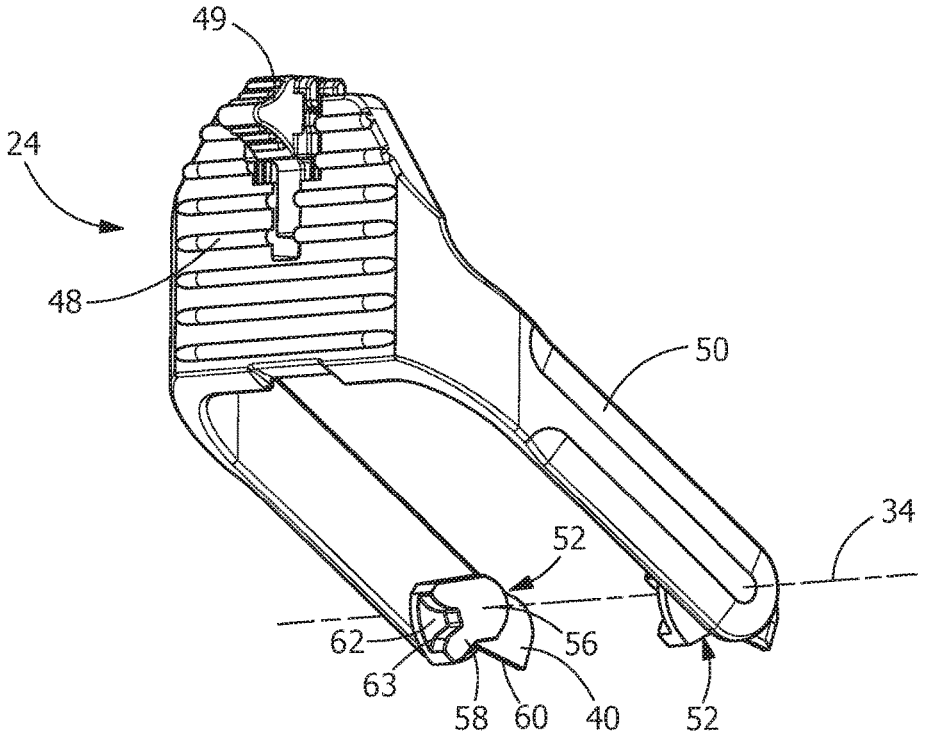
FIG. 5 is a perspective view of the lever member of the harness connector.

As best shown in FIG. 5, the lever member 24 includes a handle 48 which is formed integral with and extends perpendicularly between lever arms 50. A connector position assurance latching lever 49 is provided on the handle 48. Camming members 52 are provided at the ends of the lever arms 50. The camming members 52 have circular members (not shown) which are positioned in the lever receiving openings 32 of the bottom portion 14 of the harness connector 12. The longitudinal axis of the circular members coincides with the rotation axis 34, thereby allowing the circular members and the lever member 24 to rotate relative to the lower portion 14 of the harness connector 12.

Figure 7:
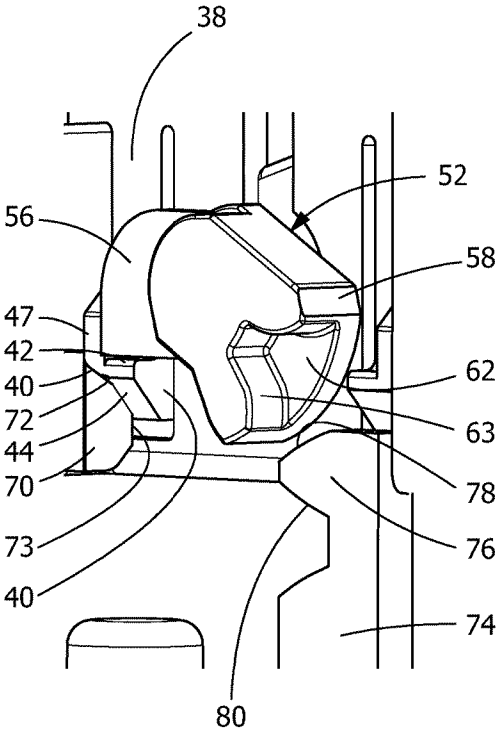
FIG. 7 is an enlarged perspective view of a lever retention arm and the latching member of the harness connector and a latch release projection and a mating post of the mating connector of FIG. 6.

As best shown in FIGS. 5 and 7, extending from the circular members of the camming members 52 on the inside of the end walls 36 are securing members 56 and post engaging members 58. The securing members 56 have engagement surfaces 60 which are configured to engage the lever engaging shoulders 42 of the holding projection of the bottom portion 14 of the connector 12. The post engaging members 58 have cavities or notches 62 which extend in a direction away from the surfaces 60 of the securing members 56.

As best shown in FIG. 1, the mating connector 20 includes two side walls 64 which are formed integral with, and are aligned perpendicular to, the end walls 66. The side walls 64 and end walls 66 are formed integral with, and extend from, a base 68, which has a larger perimeter than a perimeter about the side and end walls 64, 66. The base 68 is mounted to an electronic component (not shown), with the side and end walls 64, 66 extending outward from the electronic component. The electrical contacts 22 positioned within the mating connector 20 are connected to the electronic component.

Latch release projections 70 extend from each respective end wall 66 of the mating connector 20 in a direction away from the opposed end wall 66. The latch release projections 70 have angled or sloped surfaces 72. Engagement surfaces 73 extend from proximate the angled or sloped surfaces 72. The engagement surfaces 73 are essentially parallel to and offset from the end walls 66. In the embodiment shown, the latch release projections 70 extend from the end walls 66; however, in other embodiments, the latch release projections 70 may be provided on posts which are positioned proximate to the end walls 66.

Mating posts 74 are positioned proximate to and extend outward from the end walls 66 of the mating connector. The mating posts 74 include wedge shaped projections 76 which extend from proximate free ends thereof. The projections 76 have top angled or sloped engagement surfaces 78 that extend downward at an angle from the free end to bottom angled or sloped engagement surfaces 80 that extend upward at an angle.

Figure 6:
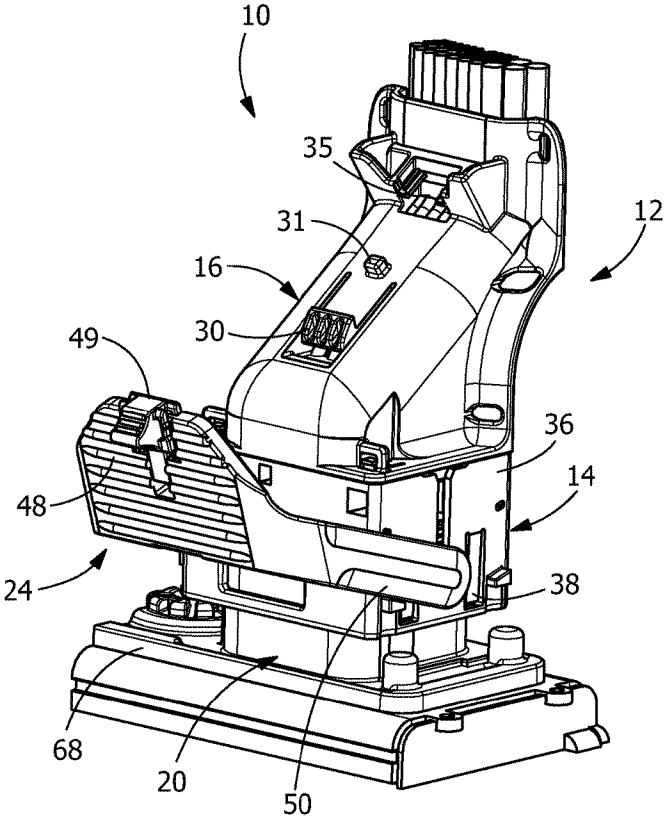
FIG. 6 is a perspective view of the harness connector and the mating connector of FIG. 1, illustrating the harness connector being moved into engagement with the mating connector.

The mating of the harness connector 12 to the mating connector 20 is shown in FIGS. 6 through 11. The harness connector 12, with the bottom portion properly secured to the top portion 14, is moved from an initial position toward the mating connector 20, as illustrated in FIG. 6. As this occurs, the lever member 24 is maintained in its initial or first position, as best shown in FIG. 7, by the cooperation of the securing members 56 of the lever member 24 with the lever retention arms 38 of the bottom portion 14. In particular, the lever engaging shoulders 42 of the holding projections 40 of the lever retention arms 38 engage the surfaces 60 of the securing members 56 to prevent the movement of the securing members 56 from the initial position shown in FIG. 7. As the securing members 56 are prevented from movement, the lever member 24 is prevented from rotating from its initial position, thereby maintaining the lever member 24 in its initial position.

Figure 9:
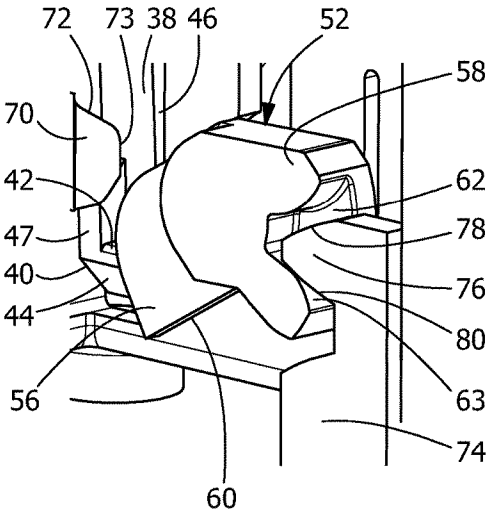
FIG. 9 is an enlarged perspective view of the lever retention arm and the latching member of the harness connector and the latch release projection and the mating post of the mating connector of FIG. 8.
Figure 8:
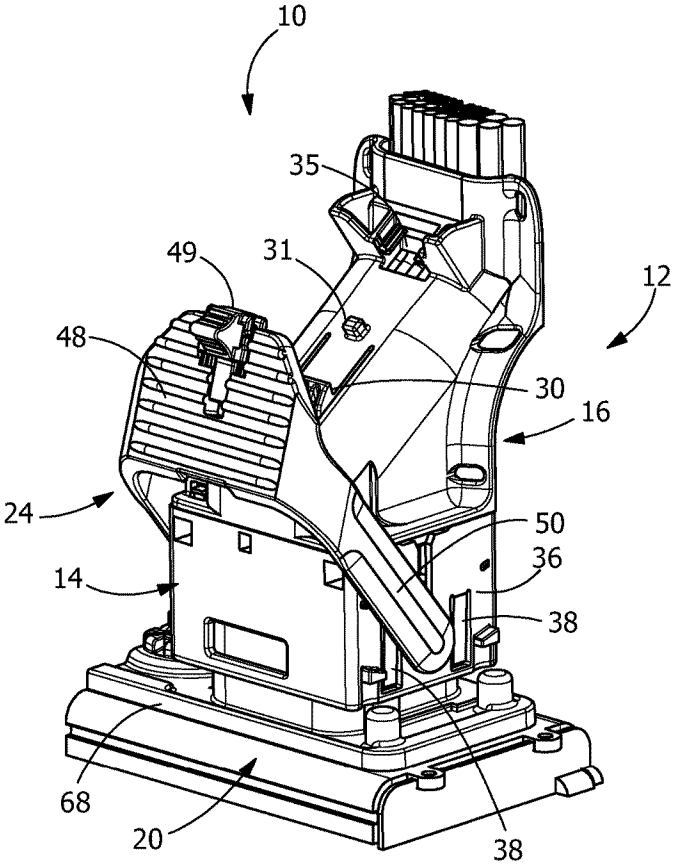
FIG. 8 is a perspective view of the harness connector and the mating connector of FIG. 1, illustrating the latching member of the harness connector engaging the mating posts of the mating connector, the latching member shown in a partially rotated position.

Continued movement of the harness connector 12 toward the mating connector 20, as shown in FIG. 8, causes the holding projections 40 of the lever retention arms 38 to engage the latch release projections 70 of the mating connector 20. In particular, as best shown in FIG. 9, the angled or sloped surfaces 44 of the holding projections 40 of the lever retention arms 38 are moved into engagement with the angled or sloped engagement surfaces 72 of the latch release projections 70.

As the harness connector 12 is moved further toward the mating connector 20, the angled or sloped engagement surfaces 72 of the latch release projections 70 forces the angled or sloped surfaces 44 of the holding projections 40 of the lever retention arms 38 to be moved away from the end walls 66 of the mating connector 20. As this occurs, the lever engaging shoulders 42 of the holding projections 40 of the lever retention arms 38 are moved out of engagement with the surfaces 60 of the securing members 56, thereby allowing the securing members 56 to move relative the holding projections 40 and relative to the bottom portion 14 of the harness connector 12. Consequently, as the surfaces 60 of the securing members 56 are released from the lever engaging shoulders 42 of the holding projections 40, the lever member 24 is allowed to be moved from its initial position toward its final position.

The cooperation of the engagement surfaces 73 of the latch release projections 70 with the engagement surfaces 47 of the holding projections 40 of the lever retention arms 38 as insertion continues maintains the lever engaging shoulders 42 of the holding projections 40 of the lever retention arms 38 in the stressed position, allowing for the surfaces 60 of the securing members 56 to be properly and completely moved from the lever engaging shoulders 42.

Figure 11:
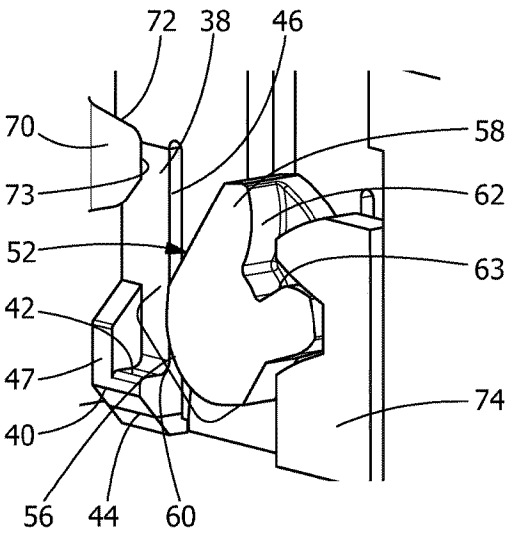
FIG. 11 is an enlarged perspective view of the lever retention arm and the latching member of the harness connector and the latch release projection and the mating post of the mating connector of FIG. 10.

With the securing members 56 released from the holding projections 40, the lever member 24 is allowed to rotate about the rotational axis 34. As this occurs, as best shown in FIG. 11, the cavities or notches 62 of the post engaging members 58 of the lever member 24 engage the wedge shaped projection 76 of the mating posts 74 of the mating connector 20.

As the lever member 24 is further rotated about the rotational axis 34, the bottom angled or slopes surfaces 80 of the projections 76 resist the upward motions of the cavity surfaces 63, causing the post engagement members 58 and the rotational axis 34 to be pulled vertically downward over the mating connector 20. As the post engagement members 58 are pulled downward, the lever member 24 and the harness connector 12 are pulled downward with enough force to overcome the static and the dynamic friction between the mating electrical contacts 18, 22 and connect the electrical contacts.

The rotation of the lever member 24 is continued until the handle 48 of the lever member 24 engages a surface of the top portion of the harness connector 12, as shown in FIG. 10. In this final or second position, the electrical contacts 18 of the harness connector 12 are fully mated with the electrical contacts 22 of the mating connector 20. In this position, the lever retaining projection 30 engages the handle 48 of the lever member 24. Additionally, the lever release locking projection 31 engages the connector position assurance latching lever 49, releasing the connector position assurance latching lever 49 from its locked position shown in FIG. 8. The connector position assurance latching lever 49 can then be moved into the connector position assurance member receiving recess 35.

The lever member 24 is retained in the fully mated position by the cooperation of the lever retaining projection 30 with the handle 48 and the cooperation of the connector position assurance latching lever 49 with the connector position assurance member receiving recess 35, thereby preventing the unwanted movement of the lever member 24 from the final position. The connector position assurance latching lever 49 can only be moved into the connector position assurance member receiving recess 35 if the lever member 24 and the camming members 52 are properly positioned and the connector 12 and mating connector 20 are full mated, thereby providing a positive indication that the connectors are mated. If the connector position assurance latching lever 49 cannot be moved into the connector position assurance member receiving recess 35, the connector 12 and mating connector 20 are not fully mated.

To unmate the electrical contacts and return the harness connector 12 to the initial staging position, an operator moves the connector position assurance latching lever 49 from the connector position assurance member receiving recess 35 back to its initial position. The operator then rotates the lever member 24 about the rotational axis 34 back toward the position shown in FIG. 6.

The lever member 24 of the harness connector 12 is maintained in its initial or unmated position until the harness connector 12 is mated with the mating connector 20, thereby helping to ensure that the lever member will not be damaged prior to mating. In addition, the inability to mate the harness connector 12 to the mating connector 20 due to improper positioning of the lever member 24 is greatly reduced.

In addition, as the lever member 24 is released from its initial or unmated position by the latch release projections 70 of the mating connector 20, the lever member 24 cannot be rotated unless the harness connector 12 is properly positioned on the mating connector 20.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly comprising:

a first housing having a plurality of first contacts provided therein, the first housing having lever retention arms with holding projections;

a second housing matable with the first housing, the second housing having a plurality of second contacts provided therein, the second housing having latch release projections and mating posts;

the first housing and the second housing being movable between an initial position to a final position in which the first contacts are fully mated with the second contacts;

a lever member rotatably attached to the first housing to rotate from a first position to a second position, the lever member having securing members and post engaging members;

lever receiving openings on opposed end walls of the first housing for receiving portions of the lever member, the lever receiving openings have circular configurations to allow the lever member to rotate about a rotational axis;

the securing members are configured to cooperate with the holding projections of the lever retention arms when the first housing is in the initial position to retain the lever member in the first position;

the latch release projections are configured to release the holding projections of the lever retention arms from the securing members as the first housing is moved toward the final position, allowing the lever member to rotate to its second position;

wherein as the lever member is rotated from the first position to the second position, the post engaging members of the lever member engage the mating posts of the second housing to move the first housing to the final position.

2. The electrical connector assembly as recited in claim 1, wherein the first housing has a top portion and a bottom portion, the first contacts are retained in the bottom portion, the lever member is retained in the bottom portion.

3. The electrical connector assembly as recited in claim 1, wherein slots extend from the lever receiving openings.

4. The electrical connector assembly as recited in claim 1, wherein the post engaging members have cavities which extend in a direction away from the securing members.

5. The electrical connector assembly as recited in claim 1, wherein the lever retention arms are provided on the end walls of the first housing, the lever retention arms are proximate to, but offset from, the lever receiving openings.

6. The electrical connector assembly as recited in claim 5, wherein the holding projections of the lever retention arms have lever engaging shoulders which are configured to engage surfaces of the securing members to retain the lever member in the first position.

7. The electrical connector assembly as recited in claim 5, wherein lever retention arm slots extend about the lever retention arms to allow the lever retention arms to move resiliently independent of the end walls.

8. The electrical connector assembly as recited in claim 5, wherein the lever retention arms have sloped surfaces which extend from free ends of the lever retention arms.

9. The electrical connector assembly as recited in claim 8, wherein engagement surfaces extend from proximate the sloped surfaces to beyond lever engaging shoulders of the holding projections, the engagement surfaces are essentially parallel to and offset from a main portion of the lever retention arms.

10. The electrical connector assembly as recited in claim 1, wherein the latch release projections extend from end walls of the second housing in a direction away from opposed end walls of the second housing.

11. The electrical connector assembly as recited in claim 10, wherein the latch release projections have angled surfaces, engagement surfaces extend from proximate the angled surfaces, the engagement surfaces are essentially parallel to and offset from the end walls of the second housing.

12. The electrical connector assembly as recited in claim 1, wherein the mating posts are positioned proximate to and extend outward from end walls of the second housing.

13. The electrical connector assembly as recited in claim 12, wherein the mating posts include wedge shaped projections which extend from proximate free ends of the mating posts.

14. An electrical connector assembly comprising:

a first housing having a plurality of first contacts provided therein, the first housing having lever retention arms on first housing end walls;

a second housing matable with the first housing, the second housing having a plurality of second contacts provided therein, the second housing having latch release projections on second housing end walls;

the first housing and the second housing being movable between an initial position to a final position in which the first contacts are fully mated with the second contacts;

a lever member rotatably attached to the first housing to rotate from a first position to a second position, the lever member having securing members;

lever receiving openings on opposed first housing end walls for receiving portions of the lever member, the lever receiving openings have circular configurations to allow the lever member to rotate about a rotational axis;

the lever retention arms having holding projections with lever engaging shoulders which are configured to engage surfaces of the securing members to retain the lever member in a first position;

the latch release projections having angled surfaces which are configured to engage the holding projections of the lever retention arms as the first housing is moved toward the final position to move the lever engaging shoulders away from the surfaces of the securing members to allow the lever member to rotate to its second position.

15. The electrical connector assembly as recited in claim 14, wherein the lever retention arms are proximate to, but offset from, the lever receiving openings.

16. The electrical connector assembly as recited in claim 15, wherein the lever retention arms have sloped surfaces which extend from free ends of the lever retention arms.

17. The electrical connector assembly as recited in claim 16, wherein engagement surfaces extend from proximate the sloped surfaces of the lever retention arms to beyond lever engaging shoulders of the holding projections, the engagement surfaces are essentially parallel to and offset from a main portion of the lever retention arms.

18. An electrical connector assembly comprising:

a first housing having a plurality of first contacts provided therein, the first housing includes lever receiving openings on opposed end walls of the first housing for receiving portions of a lever member, the lever receiving openings having circular configurations to allow the lever member to rotate about a rotational axis, lever retention arms are proximate to, but offset from, the lever receiving openings;

a lever member rotatably attached to the first housing to rotate from a first position to a second position, the lever member having securing members and post engaging members;

a second housing matable with the first housing, the second housing having a plurality of second contacts provided therein, the second housing having latch release projections and mating posts, the latch release projections extending from end walls of the second housing in a direction away from opposed end walls of the second housing, the mating posts positioned proximate to and extending outward from the end walls of the second housing;

the first housing and the second housing being movable between an initial position to a final position in which the first contacts are fully mated with the second contacts;

the securing members are configured to cooperate with the lever retention arms when the first housing is in the initial position to retain the lever member in the first position;

the latch release projections are configured to release the lever retention arms from the securing members as the first housing is moved toward the final position, allowing the lever member to rotate to its second position;

wherein as the lever member is rotated from the first position to the second position, the post engaging members of the lever member engage the mating posts of the second housing to move the first housing to the final position.

* * * * *